United States Patent [19]

Baker et al.

[11] 3,940,807

[45] Mar. 2, 1976

[54] SAFETY SUCTION OUTLET FOR POOLS

[75] Inventors: William O. Baker, Corona Delmar; Charles S. Johnson, Laguna Niguel, both of Calif.

[73] Assignee: Baker Hydro, Inc., Irvine, Calif.

[22] Filed: Aug. 13, 1974

[21] Appl. No.: 496,944

[52] U.S. Cl. ..... 4/172; 210/169

[51] Int. Cl.[2] ..... E04H 3/18; E04H 3/16

[58] Field of Search .. 141/1; 4/172, 172.18, 172.17; 210/163, 164, 165, 166, 169; 52/404; 312/109; 61/210; 68/249; 95/108; 15/222

[56] References Cited

UNITED STATES PATENTS 1,563,850 12/1925 Hartman ..... 4/172

*Primary Examiner*—Houston S. Bell, Jr.

*Attorney, Agent, or Firm*—Knobbe, Martens

[57] ABSTRACT

An outlet drain designed to provide a safety environment to the users of pools, especially therapeutic or spa type pools. A series of channels extend radially outward from the central drain aperture in the pool. The suction created in the pool system draws the water through the channels and into the central drain sump. The diameter of the channels is sufficient that a person's body adjacent the drain area will not cause blockage which would otherwise create a suction on the person's body. The overall design of the pool system provides for the automatic cleansing of the bottom surface of the pool, preventing an accumulation of dirt particles adjacent the drain area.

16 Claims, 4 Drawing Figures

SAFETY SUCTION OUTLET FOR POOLS

BACKGROUND OF THE INVENTION

This invention relates to the field of swimming pools and especially to spa or therapeutic type pools and more particularly is directed to the outlet or drain portion of the pool.

In any pool a suction is generated around the drain when the pump is operating. In therapy spa pools the volume of water pumped through the drain is quite high, as large quantities of water are being rapidly recirculated back to the pool for therapeutic purposes. It has become increasingly evident through a series of unfortunate experiebces bt various persons utilizing therapy pools that a serious safety concern in posed by the extreme suction created in the drain outlet by the high velocity water. It has been found that, when a portion of a person's body becomes positioned adjacent the drain, the blockage over the drain by the person's body creates a tremendous suction on his body which causes discomfort and, in some instances, essentially holds the person to a position adjacent the drain. This is quite critical in the case of smaller children who do not have sufficient strength in which to push away from this suction which holds them to the bottom of the pool. In some cases, panicked children have drowned.

Another drawback to the existing drain designs utilized not only in therapeutic pools, but also in normal swimming pools, is the tendency for a significant amount of dirt particles to collect in the area adjacent the drain. This is due to the fact that the dirt particles settle to the bottom of the pool and that most of the water which is drawn into the drain comes from a point above the bottom of the pool, leaving the dirt particles to remain in an essentially stagnant area of the pool around the drain.

SUMMARY OF THE INVENTION

This invention comprises a drain designed with a series of radially extending channels which effectively increase the drain diameter or the area from which water leaves the pool and enters into the drain of the pool. Water is drawn through the channels which lead into the central drain portion in the bottom of the pool. In the preferred embodiment, all of the channels are exposed their entire length to the water. The area to which the channels extend makes it impossible for a person sitting on the drain to block all of the channels. Therefore, if a person should sit on or otherwise place part of his body adjacent the drain area of these channels, no discomforting or dangerous suction would be created, because a significant amount of drain area will still be exposed to the water of the pool which will allow a sufficient amount of water to continue to flow into the drain without the creation of extreme suction against the person's body.

In the preferred embodiment of this invention, an antivortex plate is placed over the main central drain area to prevent the normal swirling action or vortex that is created as water is drawn into the central drain. It is envisioned that other embodiments of this safety drain outlet could include a larger cover plate which would extend over a larger portion of the pool bottom, creating a drain area between the cover plate and the pool bottom, having a frusto-conical shape. The cover plate would be sufficiently large and have enough apertures or passages, either through its top or around its periphery, so that no extreme suction could be created by a person being adjacent the drain area since a significant number of apertures would still be exposed to the flow of the pool water.

The safety outlet drain invention also provides a unique method of maintaining the pool in a clean condition. Preferably the inlet to the spa pool is directed so that the water circulating in the pool is in a circular or spiral path which causes any dirt which may accumulate on the bottom of the pool to also flow in a circular direction. Consequently, dirt which may exist on spaces between the channels will be moved into an adjacent channel. Water leaving the pool moves with fairly high velocity through the channels which define a limited area flow path. This high velocity flow cleans the channels of any accumulated dirt. The circular or spiral circulation is particularly enhanced if the spa pool has an overall circular shape.

Further, the use of a Swimming Pool Filter which is described in the inventor's co-pending application Ser. No. 427,089, filed Dec. 21, 1973 for a Swimming Pool Filter, now abandoned as of Oct. 16, 1974, in combination with the spa and drain removes all surface matter rapidly, and provides extremely high filter loading capacity and long filtration runs without stoppage or blockage, and further provides very simple cleaning of the filter when required.

This invention is designed for incorporation into the design of new pools by forming the channels directly in the bottom of the pool as it is fabricated. However, it is also envisioned that this invention will be utilized in retrofit units which can be placed within the main drains of existing pools. In this case, a complete molded section has a center drain sump with an outward extending flange around the drain sump including the formed radially extending channels.

DETAILED DESCRIPTION OF THE INVENTION

Figure 1:
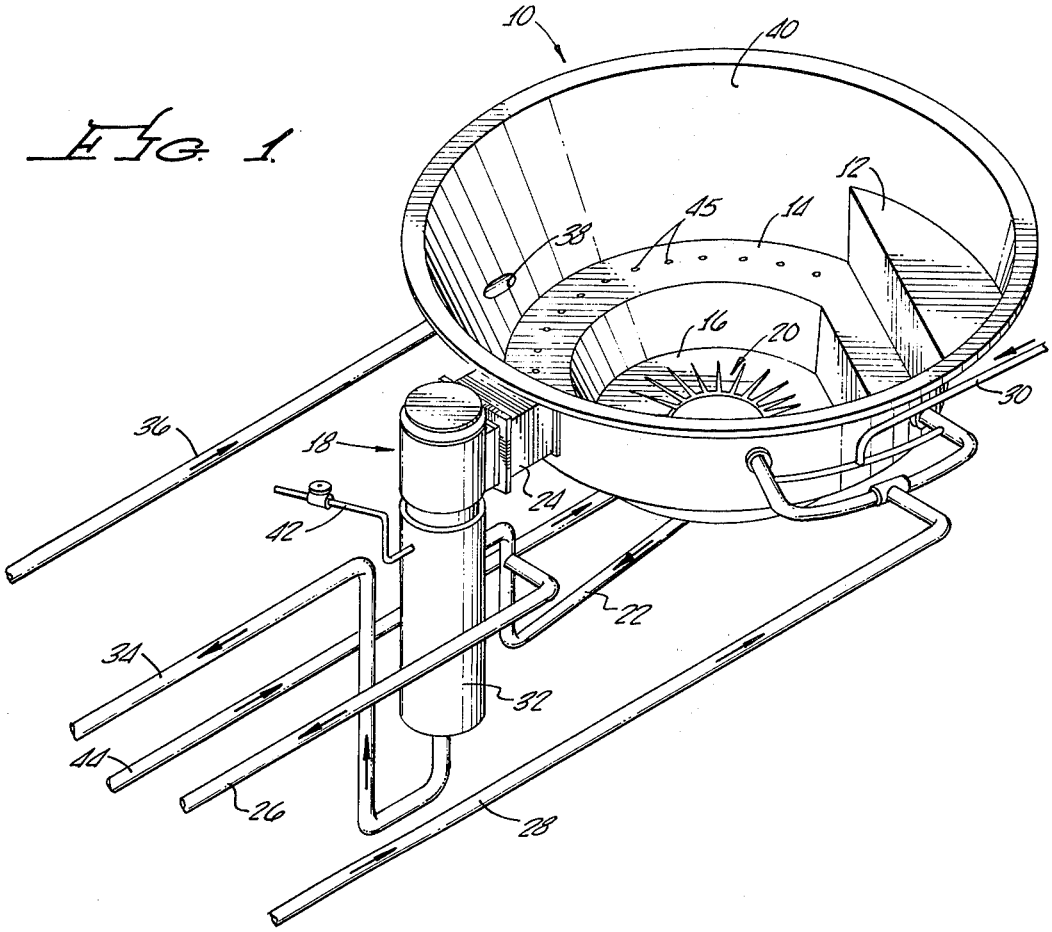
FIG. 1 is a perspective view of the invention located in a pool system.

FIG. 1 shows a typical therapy or spa type pool 10 having for example, a general circular or cylindrical shape with a step portion 12 and a seating portion 14 above the bottom 16 of the pool. Connected to the pool 10 is a filter and skimmer assembly 18. The details of the filter and skimmer assembly 18 designed for use with the spa pool 10 are shown in the present inventor's co-pending application filed on Dec. 21, 1973 for a Swimming Pool Filter, Ser. No. 427,089 now abandoned as of Oct. 16, 1974. Positioned within the bottom 16 of the pool 10 is the safety suction outlet 20.

Water leaves the pool 10 through both the drain line 22 and through the skimmer compartment 24. A bypass line 26 conducts water from the drain line 22 to a therapy pump which are not shown, when the therapy pump is operating. This water is then returned by the therapy return line 28 to the pool and just prior to entering the pool 10, is mixed with air in an air line 30 which is open to the atmosphere. Water leaving the filter portion 32 of the filter and skimmer assembly 18 follows a filtered water line 34 into a main pump and heater which are not shown, and which preferably are separate from the pump for the line 28. This filtered and heated water then returns to the pool through the filter return line 36 and enters into the pool through the inlet port 38. It should be noted that the inlet port 38 directs the water to flow around and follow the cylindrical interior surface 40 of the pool 10, generally tangentially to develop a circular or spiral flow in the filtered water. The water line 42 is used to clean the filter portion 32 as explained in the above referenced Swimming Pool Filter Application Ser. No. 427,089. The therapy air jet line 44 directs air from a blower (not shown) into the seat portion 14 of the pool 10 through a series of small apertures 45 found in the seat portion 14. In some embodiments, air may also be directed through similar small apertures in the walls, floor, face of seats, steps, or other portions of the spa.

Figure 2:
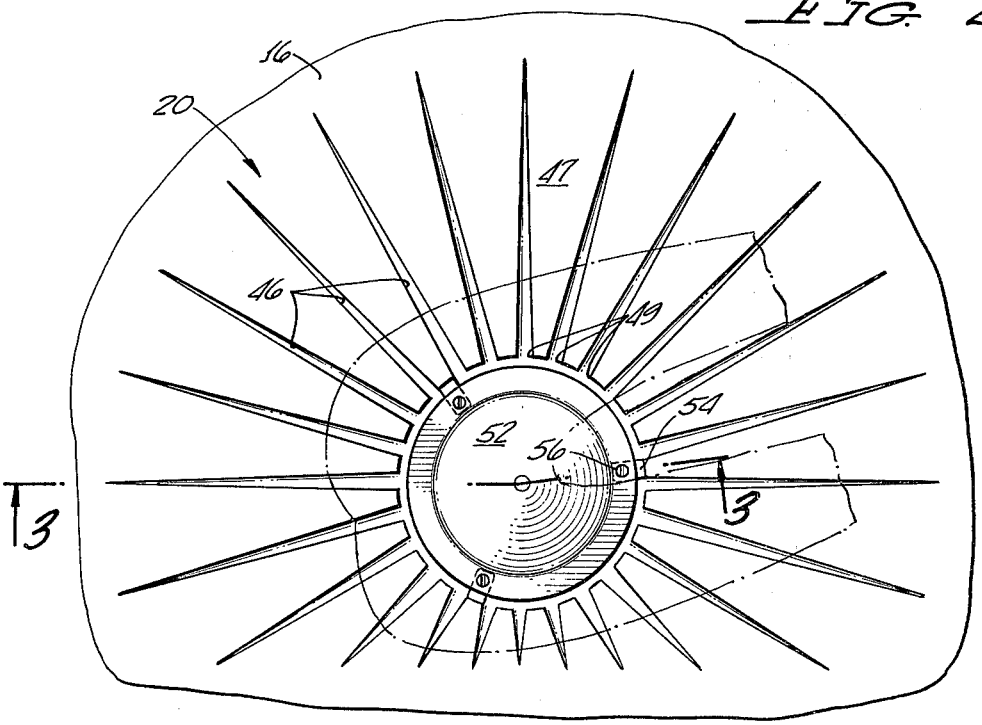
FIG. 2 is a plan view of the invention showing the radially extending channels.
Figure 3:
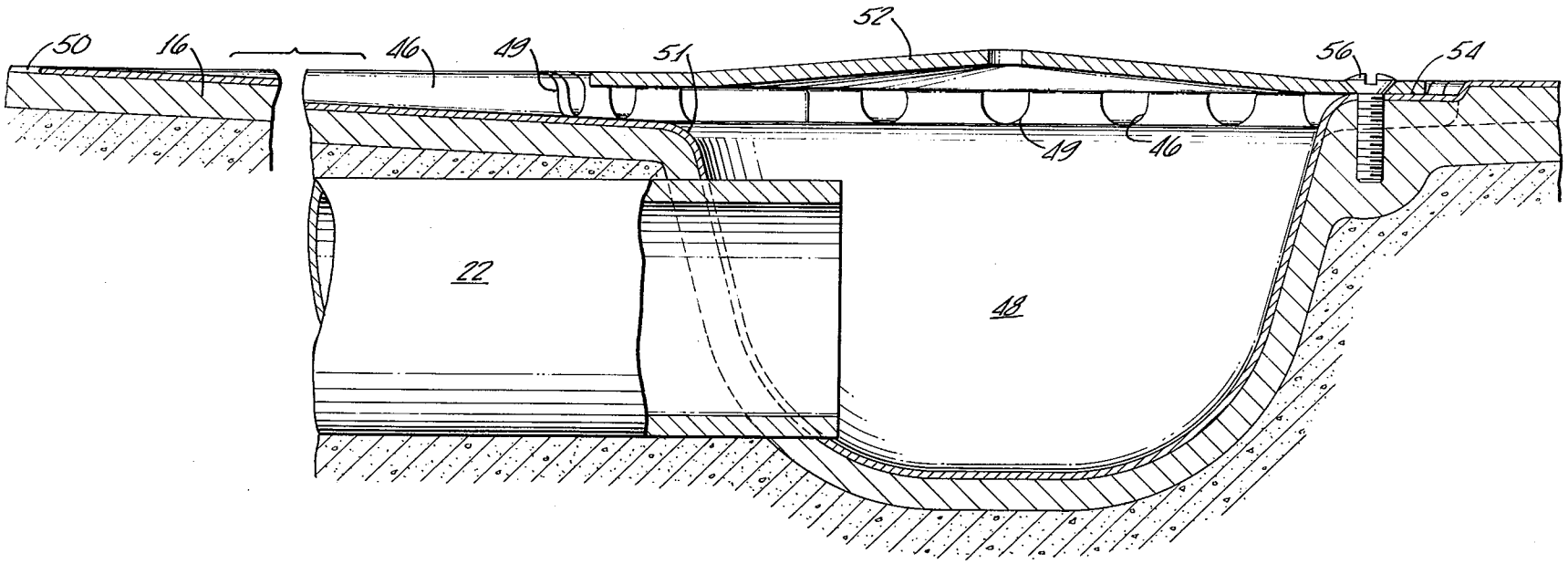
FIG. 3 is a sectional view taken along the lines 3—3 of FIG. 2.

FIGS. 2 and 3 show the safety suction outlet 20 in more detail. A series of channels 46 extend radially out from the drain sump 48 in a "sunburst" pattern. The channels 46 are open at the top for receipt of the water from the pool. As shown in FIG. 3 the channels 46 are in liquid communication with a main drain sump or cup 48. Each of the channels 46 are tapered from their inner end 49 to their outer end 50 with the inner end 49 having the greatest depth and the outer end 50 being smooth for a clean interface with the bottom 16 of the pool. Positioned over the drain sump 48, in the exemplary embodiment, is an anti-vortex plate 52 which rests on three mounting ledges 54 and is secured to the mounting ledges by screws 56. The anti-vortex plate 52 is designed to prevent the development of a vortex or swirling movement of the water as it enters into the drain sump 48. The drain line 22 is connected to the drain sump 48. As shown in FIG. 2, the channels 46 are tapered in a lateral direction with the width of the channel being greater at the inner end 49 and being narrowed to a point at the outer end 50. The particular design of the safety suction outlet shown in FIG. 2 with some of the channels 46 being shorter than others on one side of the anti-vortex plate 52 is the result of the placement of the step portion 12 as shown in FIG. 1 on one side of the therapy pool 10.

The safety suction outlet 20 as shown in FIGS. 2 and 3 is molded integrally with the pool bottom, or chemically bonded thereto, in the fabrication of a therapy or spa pool. However, it is desirable also to have a safety suction outlet designed for retrofit incorporation in existing pools having a main drain outlet.

Figure 4:
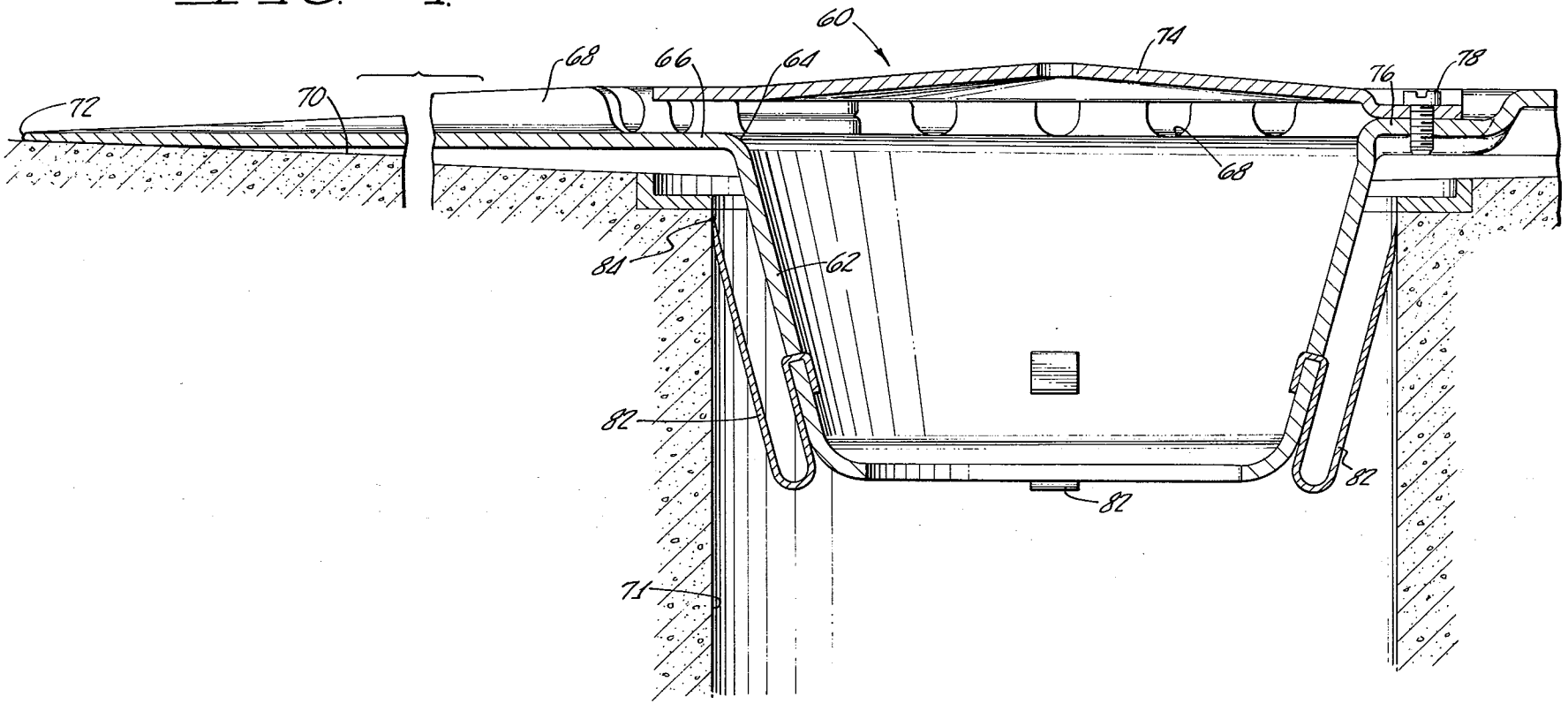
FIG. 4 is a sectional view of an alternate embodiment of the invention.

Referring to FIG. 4 an alternate embodiment 60 of the safety suction outlet is shown comprised of a drain sump 62 having at its upper edge 64 an outwardly extending flange 66. Formed on the upper side of the flange 66 are a series of channels 68 which have the same configuration as the channels 46 previously discussed with respect to FIGS. 2 and 3. The flange portion 66 rests on the general fustro-conical bottom 70 of the pool adjacent the main drain outlet 71, and the outer edge 72 of the flange 66 is tapered in order to provide a smooth interface between the pool bottom 70 and the flange 66, eliminating possible obstacle to the user. Mounted over the drain sump portion 62 is an anti-vortex plate 74 which is mounted on three step portions 76 and secured thereto by the screws 78.

Because the drain outlets 71 of various pools may have different internal diameters, a series of adjustable spring clips 82 are attached to the drain basket 62 in order to provide a secure fitting between the safety suction outlet and the main drain 71. The spring clips 82 are designed so that the upper end 84, when compressed toward the drain sump 62, will exert a pressure against the main drain 71 to provide a tight fit. Also, the upper ends 84 of the spring clips 82 are designed to dig into the main drain wall 71 in order to prevent unintended removal of the safety suction outlet 60.

Turning to the operation and use of the safety suction outlet 20, as shown in FIGS. 1 through 3, when th spa is in the therapy mode, large quantities of water are pumped from the spa by the therapy pump through lines 22 and 26 and returned to the spa through line 28. This results in a large amount of suction or force being introduced through the outlet drain 20 by the velocity of the water flowing through it. In previous pool designs the drain area was limited to essentially the size outlined by the upper edge 51 of the drain sump 48 as shown in FIG. 3. Since this area was not paricularly large, it was possible for an individual using the pool to inadvertently cover this small drain area, for example by sitting on it, resulting in a strong suction being developed on the person's body which would cause the person to become essentially held to the bottom of the pool. This situation became extremely unsafe in the case of small children who would not have sufficient strength to break the suction which had been created on a portion of their body.

The present invention as shown in the figures with the utilization of the series of outward extending channels 46 greatly increases the size of the suction or outlet area for the water leaving the pool, so that it becomes essentially impossible for an individual to block the outlet flow of the water and thereby eliminates the possibility of a suction being created on the person's body. For example, the overall diameter from one channel end to the opposite channel end may be about two feet. Water flows through the channels 46 and down into the drain sump 48 and out the drain line 22. Because the channels 46 extend out so far, an individual (shown in phantom on FIG. 2) sitting or resting adjacent the safety suction outlet 20 could not conceivable block the flow of water into all the channels 46. However, the channels are deep enough that a person sitting on them would not protrude sufficiently far down into the channels to block the flow, particularly in the area near the drain cup 48, and the water would flow beneath the individual through the channels 46.

The design of the safety suction outlet 20 also aids in automatic cleaning action of the bottom of the pool adjacent the drain area. Since the water is introduced through the inlet port 38 to produce a circular motion through the swimming pool 10 following the cylindrical surface 40 of the pool, causing water to circulate in a circular direction on the bottom portions 47 located between adjacent channels 46 will be moved circumferentially into an adjacent channel 46. Consequently, the circular movement of the water over the sections 47 will move any loose dirt that is found on these areas into the channels 46. As the channels present a relatively confined cross-section flow through the channels toward the drain will be accelerated relative to the flow toward the drain in a pool without the device of this invention. This result is aided by the anti-vortex plate which directs the suction toward the channels. This higher velocity flow in the channels will then move the dirt radially into the drain for ultimate disposal in the filter system.

It should be noted that the above discussion is equally applicable to the retrofit embodiment of the invention as shown in FIG. 4.

It is envisioned in this invention that other designs of this basic suction outlet system can be devised which would increase the suction area or outlet flow of water area in the bottom of the spa pool. Other such designs may include the use of a large plate resting on the general fustro-conical shape of the pool adjacent the main drain with the plate having a series of apertures over a large enough area that would eliminate any possibility of a person blocking the flow of water through these apertures. Such apertures might be dispersed over the surface of plate or located at its periphery. In any event, the apertures are over an area too large to be blocked by a person using the pool.

It also is envisioned that the anti-vortex plate might be eliminated and a conventional grate substituted in some embodiments; although the anti-vortex plate is desirable in directing the suction through the channels. It also should be understood that the spa could be of shapes other than cylindrical, although the cylindrical wall shape encourages such circulation.

What is claimed is:

1. A safety suction outlet for a pool comprising:
a drain aperture in the bottom of said pool; and
means for extending the pool water outlet area for flow into said drain aperture to include an area on said bottom of said pool much larger than said aperture, said extending means being sufficiently large to virtually eliminate the possibility that a person of normal size could block a sufficient portion of the outlet area to create a heavy suction on said person when said person is positioned on said outlet area.

2. A safety suction outlet for a pool as defined in claim 1 and further comprising an anti-vortex plate positioned over said aperture.

3. A safety suction outlet for a pool as defined in claim 1 wherein said extending means are a plurality of channels extending outward from said aperture.

4. A safety suction outlet for a pool as defined in claim 3 wherein said channels are open at the top and are dimensioned so that their cross-section is not blocked by a person of normal size sitting thereon.

5. A safety suction outlet for a pool as defined in claim 3 wherein said channels are tapered to increase in depth toward said aperture.

6. A safety suction outlet for use in a pool, said safety suction outlet comprising:
a drain unit situated in the bottom of said pool, said drain unit having an upper edge forming an aperture in said bottom of said pool,
a series of channels extending radially outward from said aperture,
an anti-vortex plate positioned over said drain unit covering said aperture, the bottoms of said channels adjacent said aperture being lower than said anti-vortex plate; and
an outlet pipe in liquid communication with said drain unit, said outlet pipe receiving water from said pool throught said series of channels, said series of channels providing a large outlet area of water for entry into said drain unit resulting in the elimination of the creation of a holding suction on a person's body when positioned on said outlet area.

7. A safety suction outlet unit for insertion in the main outlet aperture of a pool, said unit comprising:
a cup section positioned within said aperture;
a radially extending flange connected to the upper portion of said cup section and resting on the bottom of said pool;
a series of channels formed in said flange, said channels in liquid communication with said cup section and extending radially sufficiently far to avoid blockage by a person of normal size sitting thereon; and
a cover plate positioned over said cup section, said cover plate encouraging the flow of water from said pool into said cup section to follow said series of channels.

8. A safety suction outlet unit as defined in claim 7 and additionally comprising means located on said cup section for accommodating various sized main outlet apertures.

9. A safety suction outlet unit as defined in claim 8 wherein said accommodating means comprises means for locking said safety suction unit in said main outlet aperture.

10. A safety suction outlet unit as defined in claim 8 wherein said allowing means comprises a series of adjustable spring clips located around said cup section.

11. A safety suction outlet unit as defined in claim 7 wherein the bottoms of said channels are tapered downward from the outer edge portion of said flange to the inner edge portion of said flange adjacent said cup portion, said outer edge portion of the flange being generally flat to produce a smooth surface interface between said bottom of said pool and said outer edge portion, so that no obstacle is presented which would tend to cause a person discomfort.

12. A pool in combination with a self-cleaning suction outlet, said combination comprising:
a drain aperture in the bottom of said pool,
a series of channels located on the bottom of said pool and extending out from said aperture, said channels being open at the top and in liquid communication with said drain aperture,
an outlet pipe in liquid communication with said drain aperture to receive water from said pool, the greatest portion of water to said aperture moving through said channels to reduce the accumulation of dirt in said channels; and
an inlet pipe on said pool, said inlet pipe directing incoming water in a generally circular direction over said series of channels, said circular moving water causing any dirt accumulated between said channels to be moved into said channels causing said pool bottom to remain clean.

13. A spa pool in combination with a safety suction outlet as defined in claim 12 wherein:
said pool is generally cylindrical in shape; said channels extend out radially from said drain aperture, and
a pump is connected between said outlet pipe and said inlet pipe to circulate water therethrough.

14. A spa pool in combination with a safety suction outlet as defined in claim 12 and further comprising an anti-vortex plate over said aperture.

15. A spa pool in combination with a safety suction outlet as defined in claim 13 wherein said channels extend outwardly to encompass an area too large for a person of normal size to block when sitting on the drain.

16. A pool in combination with a self cleaning suction outlet as defined in claim 12 and further comprising a combination skimmer-filter in the wall of said pool.

* * * * *